United States Patent [19]

Reynolds et al.

[11] Patent Number: 4,988,433

[45] Date of Patent: Jan. 29, 1991

[54] DEMETALATION OF HYDROCARBONACEOUS FEEDSTOCKS USING MONOBASIC CARBOXYLIC ACIDS AND SALTS THEREOF

[75] Inventors: John G. Reynolds, El Cerrito; David C. Kramer, San Anselmo, both of Calif.

[73] Assignee: Chevron Research Company, San Francisco, Calif.

[21] Appl. No.: 530,720

[22] Filed: May 30, 1990

Related U.S. Application Data

[63] Continuation of Ser. No. 239,152, Aug. 31, 1988, abandoned.

[51] Int. Cl.[5] ..... C10G 1/00

[52] U.S. Cl. ..... 208/251 R; 208/252; 208/282; 208/309; 423/DIG. 16; 585/866

[58] Field of Search ..... 208/252, 251 R, 282, 208/309; 423/DIG. 16; 585/866

[56] References Cited

U.S. PATENT DOCUMENTS

| | | | |
|---|---|---|---|
| 2,739,103 | 3/1956 | Thompson | 208/252 |
| 2,744,853 | 5/1956 | Kavanagh et al. | 208/252 |
| 2,767,123 | 10/1956 | Hickok et al. | 208/252 |
| 2,778,777 | 3/1957 | Powell | 208/252 |
| 3,023,160 | 2/1962 | Stedman | 208/240 |
| 3,153,623 | 10/1964 | Eldib et al. | 208/251 R |
| 3,377,268 | 4/1968 | Li | 208/252 |
| 3,449,243 | 6/1969 | Shong, Jr. et al. | 208/251 R |
| 4,432,865 | 2/1984 | Norman | 208/252 |
| 4,439,345 | 3/1984 | Duke | 252/330 |
| 4,645,589 | 2/1987 | Krambeck et al. | 208/252 |

*Primary Examiner*—Helane E. Myers

[57] ABSTRACT

Monobasic carboxylic acids or salts thereof are used to remove metals, particularly calcium and iron, from hydrocarbonaceous feedstocks. An aqueous solution of the acid is used to extract the metals from the feedstock prior to processing. Acetic acid is the preferred carboxylic acid.

14 Claims, No Drawings

DEMETALATION OF HYDROCARBONACEOUS FEEDSTOCKS USING MONOBASIC CARBOXYLIC ACIDS AND SALTS THEREOF

This is a continuation of application Ser. No. 239,152, filed Aug. 31, 1988 now abandoned.

BACKGROUND OF THE INVENTION

This invention relates to a process for the removal of metals, particularly calcium and iron, from metals-containing petroleum crudes or heavy hydrocarbonaceous residua using acetic acid as a sequestering or chelating agent. A few, but increasingly important, petroleum crude feedstocks, residua, and deasphalted oil derived from them, contain levels of calcium or iron which render them difficult, if not impossible, to process using conventional refining techniques. The metals contaminants causing particular problems are in the form of nonporphyrin, organometallically-bound compounds. These species have been attributed to either naturally occurring calcium or iron complexes or solubilized calcium from recovery waters which comes in contact with crude oils, or solubilized iron from corrosion and decay of iron-bearing equipment which comes in contact with crude oils. One possible class of calcium or iron-containing compounds identified in particular is the respective naphthenates and their homologous series. These organometallic compounds are not separated from the feedstock by normal desalting processes, and in a conventional refining technique they can cause the very rapid deactivation of hydroprocessing catalysts. Examples of feedstocks demonstrating objectionably high levels of calcium compounds are crudes from China such as Shengli No. 2; examples of high iron-containing crudes include those from San Joaquin Valley in California, generally contained in a pipeline mixture referred to as San Joaquin Valley crude or residuum.

The problems presented by calcium and iron in petroleum feedstocks and the necessity for their removal have only been recently appreciated, and the prior art contains relatively few references to their removal. Metals removal generally using organic compounds, however, has been addressed in the prior art, specifically for the removal of known metallic contaminants, such as nickel, vanadium, and/or copper. The compounds are also ordinarily found in feedstocks as porphyrins and other organometallic compounds.

In Lerner U.S. Pat. No. 3,052,627, metals contaminants are removed from crude petroleum feedstocks using a 2-pyrrolidone-alcohol mixture. In Payne U.S. Pat. No. 3,167,500, metallic contaminants, such as metal-containing porphyrins, are removed from petroleum oils using a condensed polynuclear aromatic compound having a preferred C/H ratio and a molecular weight ordinarily called pitch binders. In Eldib et al., U.S. Pat. No. 3,153,623, selected commercially available organic compounds of high dielectric strength were added- to assist in a process basically encompassing the electrically-directed precipitation of metals. Duke U.S. Pat. No. 4,439,345, discloses the use of carboxylic acids to demulsify by demetalation the middle phase emulsion of an enhanced oil recovery product. Krambeck, et. al. U.S. Pat. No. 4,645,589, discloses a method for removing vanadium and nickel metal porphyrins from hydrocarbon oils using phosphoric acid and its salts. Powell U.S. Pat. No. 2,778,777, teaches the use of relatively high concentrations of sulfuric acid for the removal of porphyrinic heavy metals, such as vanadium, nickel and iron. Powell also teaches the removal of inorganic metal salts of light metals, such as calcium, sodium, and magnesium, also using relatively high concentrations of sulfuric acid, and ordinary desalting technology.

In U.S. applications Ser. Nos. 901,341, 901,342, 901,343, 901,344, 901,345 and 164,597, commonly assigned to the assignee of the present invention, various agents including aminocarboxylic acids, hydoxocarboxylic acids, dibasic carboxylic acids, and carbonic acid, and their salts, are used in similar processes to remove nonporphyrin organometallic contaminants from hydrocarbonaceous feedstocks.

Japanese Patent Publication Sho No. 5230284, Fushimi, teaches a method for removing various metals contaminants from crude oil using a combination of mineral acid, alkyl phosphate ester and an oxidant. Japanese Patent Publication Sho No. 4722947 teaches a lower level of metals removal using a combination of alkyl phosphate esters and alkyl carboxylic acid in the presence of mineral acids.

Norman U.S. Pat. No. 4,432,865, teaches a process for treating used motor oil to remove metals using a polyhydroxy compound and a polyfunctional mineral acid.

Among other factors, it has now been unexpectedly found that the metals-containing contaminants, particularly those containing calcium and iron, may be effectively removed from the feedstocks of the present invention by binding the metal compounds using acetic acid and its salts.

SUMMARY OF THE INVENTION

The process comprises of a method for demetalating hydrocarbonaceous feedstocks, particularly crude petroleum or residua using an aqueous solution containing the acid. The method is particularly appropriate for removing calcium and iron, especially nonporphyrin, organically-bound calcium or iron compounds. The preferred metal chelating agents are the monobasic carboxylic acids, such as acetic acid and salts thereof in an aqueous solution. In the preferred process, the feedstock to be demetallized is intimately and thoroughly mixed with an aqueous solution of the acetic acid and its salts. The metals complex with the agent; the resulting complex being extracted into the aqueous phase. The aqueous phase and the hydrocarbon phase are separated and the hydrocarbonaceous feedstock is then available for hydroprocessing.

DETAILED DESCRIPTION OF THE INVENTION

Various petroleum crude feedstocks and residua produced from them contain unacceptably high levels of calcium or iron-containing metals contaminants. These metallic ions, especially organically-bound, or calcium or iron-containing compounds cause distinct processing difficulties in standard hydroprocessing techniques, ordinarily by rapid deactivation or fouling of the hydroprocessing catalyst. This invention comprises a method for removing those metals-containing contaminants prior to hydroprocessing of the crude or residua by using a chelating agent or agents, monobasic carboxylic acids and salts thereof.

The invention can be applied to any hydrocarbonaceous feedstock containing an unacceptably high level of calcium or iron. Those feedstocks can include crude petroleum, especially from particular sources, such as San Joaquin Valley crude, including, for example, South Belridge, Kern Front, Cymric Heavy, Midway Sunset, or Shengli No. 2 from China or mixtures thereof. Additionally, atmospheric or vacuum residua or solvent deasphalted oils derived from these crudes, also can have unacceptably high calcium or iron levels. It is within the contemplation of the invention that any other hydrocarbonaceous feedstocks, such as shale oil, liquefied coal, beneficiated tar sand, etc., which may also contain similar metals contaminants, may be processed using this invention.

The basic process is relatively simple: The crude, residuum or deasphalted oil to be processed is mixed with an aqueous solution of the monobasic carboxylic acid or salts thereof, and a base, preferably $NH_3$ or $NH_4OH$, for adjusting the pH above 2, and preferably between 5 to 9. The calcium or iron is readily bound or chelated to the acid ion to form a complex. This metal-monobasic carboxylic acid complex is ionic and water soluble, and is therefore extracted into the aqueous phase of the mixture. The two phases, the aqueous and the crude or hydrocarbonaceous phase, are separated or permitted to separate. The aqueous solution containing the calcium or iron contaminant is removed, resulting in a hydrocarbon feed with removed metals, which then can be handled in the same manner as any other carbonaceous feed and processed by conventional hydroprocessing techniques. It is contemplated that the physical separation process is ordinarily to be done in a conventional crude desalter, which is usually used for desalting petroleum crudes prior to hydroprocessing. The separation may be done by any separation process, however, and may include countercurrent extraction.

It is well known that monobasic carboxylic acids have a affinity for calcium, iron and other metal ions. Known as chelating agents, a common example of these monobasic carboxylic acids is: acetic acid $CH_3COOH$; molecular weight 60.04, known also as ethanoic acid.

Another monobasic carboxylic acid which has shown comparable activity toward calcium and iron is benzoic acid. These acids all exhibit polyfunctionality like acetic acid which partially accounts for their chelation ability toward calcium and iron. Monobasic carboxylic acids, and acetic acid in particular, are members of a broad class of multidentate chelating ligands which complex or coordinate metal ions. These compounds form very stable metal ligand complexes. These monobasic carboxylic ligands form complexes with calcium and iron ions which are stable and can be isolated. They are also water soluble, allowing for their separation from hydrophobic phases. Acetic acid and its salts will complex other metal ions in aqueous solution but appear to have little or no effect on the more commonly found, ordinary organometallic metal contaminants in petroleum, such as nickel and vanadium petroporphyrins and asphaltenes. As discussed previously, in order for the metal to bind appropriately to the acetic acid, the pH should be above 2, and preferably 5 to 9. One difficulty with the addition of base, however, is the formation of emulsions. Therefore, the most preferred pH is 6.

The ratio of aqueous acetic acid solution to hydrocarbonaceous feed should be optimized, with the determining factor being the separation method. Commercial desalters, for example, ordinarily run at 10% or less aqueous volume. Countercurrent extraction may also be used for separation. Effective separations have been done at 50% or more aqueous volume.

The contact time between the aqueous extraction solution and the hydrocarbonaceous feed is important, and may vary from between less than a few seconds to about 4 hours. The preferred contact time is from about 1 second to 1 hour.

EXAMPLES

Example 1—Acetic Acid

In laboratory trials, the results of which are detailed in Table I below, 75 grams of desalted Shengli No.2 vacuum residuum feed containing 54 ppm Ca was dissolved in 75 grams of toluene to give a workable viscosity. This solution was mixed with 75 grams of an aqueous solution containing the stated amounts of acetic acid expressed as moles acid per mole calcium in the residuum and enough ammonium hydroxide to increase the pH to between 6 and 7. The crude and aqueous solution were poured into a glass vessel and a demulsifier, tradenamed Treatolite L-1562, was added. The vessel was heated to 180° and the contents were stirred for 20 minutes with an electric stirrer. The oil and aqueous phases were allowed to separate. The toluene was removed from the oil phase by heating under vacuum. The results are shown in Table I below.

TABLE I

CALCIUM REMOVAL FROM VACUUM RESIDUUM USING ACETIC ACID AND AMMONIUM HYDROXIDE
Stirred 20 min., 180° F., VR:Toluene:acid solution = 1:1:1
Acid solution Neutralized to pH 6–7 with $NH_4OH$ Solution.

| Example | Moles Acid per Mole Ca | ppm Ca in Product | % Ca Removal |
|---|---|---|---|
| 1a | 0 | 49 | 9 |
| 1b | 3 | 35 | 35 |
| 1c | 10 | 22 | 59 |
| 1d | 30 | 9 | 83 |

Example 2—Benzoic Acid

In laboratory trials, the results of which are detailed in Table II below, procedure similar to Example 1 was followed. Here, however, benzoic acid used instead of acetic acid. The amounts of benzoic acid used are expressed as moles acid per mole calcium in the residuum. The results are shown in Table II below.

TABLE II

CALCIUM REMOVAL FROM VACUUM RESIDUUM USING BENZOIC ACID AND AMMONIUM HYDROXIDE
Stirred 20 min., 180° F., VR:Toluene:acid solution = 1:1:1
Acid Solution Neutralized to pH 6–7 with $NH_4OH$ Solution

| Example | Moles Acid per Mole Ca | ppm Ca in Product | % Ca Removal |
|---|---|---|---|
| 2a | 0 | 49 | 9 |
| 2b | 1 | 35 | 35 |
| 2c | 2 | 25 | 54 |
| 2d | 5 | 7 | 87 |

Example 3—Continuous Calcium Removal

In tests in a two-stage crude oil desalter, calcium was removed continuously from 54,000 BPD of crude containing 23–28 ppm Ca. An aqueous solution of acetic acid and ammonia was prepared in a large tank. The pH of the solution was 7.5. The solution was pumped into the inlet water line to the second stage of the desalter where it mixed with more fresh water. The operating conditions and the amounts of oil/water weight ratio was maintained above 30 and the temperature was maintained at 250° F. or above. The aqueous phase containing the acetic acid and ammonia was mixed with the crude in the usual way by passing through static mixers. Samples of the oil and water phases from the second stage were taken after they separated in the desalter vessel. The results are shown in Table III.

TABLE III

CALCIUM REMOVAL FROM CRUDE DURING CRUDE DESALTING USING ACETIC ACID AND AMMONIA (AMMONIUM ACETATE)

| | Test 1 | Test 2 | Test 3 |
|---|---|---|---|
| Crude Rate (BPD) | 51,000 | 54,000 | 54,000 |
| Desalter Temperature (°F.) | 284 | 250 | 266 |
| Desalter Pressure (psig) | 107 | 107 | 92 |
| Estimated Residence Time in Static Mixers | 2 | 2 | 2 |
| INJECTION RATES: | | | |
| Fresh Water (GPH) | 1,350 | 1,400 | 1,400 |
| Additive Solution | | | |
| Water (lb/hr) | 0 | 5,820 | 8,980 |
| Acid (lb/hr) | 0 | 98 | 151 |
| Ammonia (estimated lb/hr) | 0 | 30 | 43 |
| pH | — | 7.5 | 7.5 |
| ANALYTICAL RESULTS: | | | |
| Moles Acid per Mole Ca in Feed | 0 | 3.3 | 6.2 |
| Ca in Crude Feed (ppm) | 18 | 28 | 23 |
| Ca in Desalted Crude (ppm) | 19 | 15 | 11 |
| % Ca Removal | 0 | 46 | 52 |
| Ca in Effluent Water (ppm) | 0 | 384 | 366 |
| Fe in Crude Feed (ppm) | 5 | 7 | 5 |
| Fe in Desalted Crude (ppm) | 5 | 6 | 4 |
| % Fe Removal | 0 | 14 | 20 |

What is claimed is:

1. A method for removing metals selected from the group consisting of Group IIA and Group VIII metals from hydrocarbonaceous feedstock comprising:

mixing said hydrocarbonaceous feedstock with an aqueous solution of a metals sequestering agent, said agent consisting essentially of monobasic carboxylic acid or salts thereof, whereby said aqueous solution forms an aqueous phase containing said metals and a hydrocarbon phase; and separating said aqueous phase from the substantially demetalated hydrocarbon phase.

2. The method as claimed in claim 1 wherein the metal is calcium.

3. The method as claimed in claim 1 wherein the metal is iron.

4. The method as claimed in claim 1 wherein the metals are organometallically-bound, nonporphyrin compounds.

5. The method as claimed in claim 4 wherein the compounds are compounds of calcium.

6. The method as claimed in claim 4 wherein the compounds are compounds of iron.

7. The method as claimed in claim 1 or 4, wherein said metals sequestering agents comprise acetic acid and salts thereof.

8. The method as claimed in claim 7 wherein the pH of the mixing step is adjusted to 2 or above.

9. The method as claimed in claim 8 wherein the pH of the mixing step is adjusted to 5 or above.

10. The method as claimed in claim 8 wherein the pH is adjusted by adding ammonia or ammonium hydroxide.

11. The method as claimed in claim 9 wherein the pH is adjusted by adding ammonia or ammonium hydroxide.

12. The method as claimed in claim 7 wherein the mixing time is 1 second or more.

13. The method as claimed in claim 1 wherein said separating is performed by a desalting process or counter-current extraction.

14. The method as claimed in claim 1 wherein the hydrocarbonaceous feedstock is selected from the group comprising:

crude petroleum, atmospheric or vacuum residua, deasphalted oils from such feedstocks, shale oil, liquefied coal, and tar sand effluent.

* * * * *